US010994189B2

(12) United States Patent
Fukae

(10) Patent No.: US 10,994,189 B2
(45) Date of Patent: May 4, 2021

(54) GLOVE STRUCTURE

(71) Applicant: Toyoharu Fukae, Nara (JP)

(72) Inventor: Toyoharu Fukae, Nara (JP)

( * ) Notice: Subject to any disclaimer, the term of this patent is extended or adjusted under 35 U.S.C. 154(b) by 127 days.

(21) Appl. No.: 16/332,192

(22) PCT Filed: Sep. 14, 2016

(86) PCT No.: PCT/JP2016/077054
§ 371 (c)(1),
(2) Date: Aug. 16, 2019

(87) PCT Pub. No.: WO2018/051421
PCT Pub. Date: Mar. 22, 2018

(65) Prior Publication Data

US 2019/0388769 A1 Dec. 26, 2019

(51) Int. Cl.
*A63B 71/14* (2006.01)

(52) U.S. Cl.
CPC ..... *A63B 71/143* (2013.01)

(58) Field of Classification Search
CPC ..... A63B 71/143; A63B 2102/18; A63B 2102/182; A63B 71/14; A63B 71/414; A63B 2069/0011; A41D 19/01523; A41D 19/01588; A41D 19/0041; A41D 19/0048;
(Continued)

(56) References Cited

U.S. PATENT DOCUMENTS 952,556 A * 3/1910 Yeager ..... A63B 71/143 2/19
2,113,934 A * 4/1938 Denkert ..... A63B 71/143 2/19

(Continued)

FOREIGN PATENT DOCUMENTS

JP S57-197982 U 12/1982
JP H11-206949 A 8/1999
JP 2013-230366 A 11/2013

*Primary Examiner* — Amy Vanatta
(74) *Attorney, Agent, or Firm* — IP Business Solutions, LLC

(57) ABSTRACT

The purpose of the present invention is to provide a ball glove structure that improves glove functionality for a player of baseball or softball even through provided with a box-like protective thumb-slot. The ball glove generally comprises an outer shell where the shell part Is formed by sewing together a ball catching palm surface part (1) and a backing surface part (2) provided with thumb and finger stalls or slots with a lace (3). The inventive glove structure comprises (A) a box-like thumb protective stall or slot (21) provided with a hem spread opening (21*e*) having an enlarged angle (α) at the bottom portion with regard to the center line of the thumb slot for easy movement of the thumb bottom at the time of opening/closing of the glove and also (B) a fixing structure comprising a pair of slits (10*a*, 10*a*) for dividing a hand opening band (5) into two parts; one is a thumb side and the other is a little finger side and a pair of straps (11*a*,11*b*) for fixing the bottom of the index finger to make a secure movement axis for opening/closing the glove as well as fastening the divided hand opening band for preventing the glove hand from slipping out from the hand opening band. Preferably, the little finger is fixed by the adjustable strap structure (23) to fix the little finger.

4 Claims, 6 Drawing Sheets

(58) Field of Classification Search
CPC . A41D 2600/10; A41D 13/081; A41D 13/087
USPC ..... 2/19
See application file for complete search history.

(56) References Cited

U.S. PATENT DOCUMENTS

| | | | | | |
|---|---|---|---|---|---|
| 3,528,107 | A * | 9/1970 | Rosenbaum | A63B 71/143 | 2/19 |
| 3,576,036 | A * | 4/1971 | Latina | A63B 71/143 | 2/19 |
| 3,602,915 | A * | 9/1971 | Collins | A63B 71/143 | 2/19 |
| 4,346,481 | A * | 8/1982 | Latina | A63B 71/143 | 2/19 |
| 4,477,927 | A * | 10/1984 | Tsubota | A63B 71/143 | 2/19 |
| 4,853,975 | A * | 8/1989 | Clevenhagen | A63B 71/143 | 2/19 |
| 5,575,005 | A * | 11/1996 | Walker | A63B 71/143 | 2/161.1 |
| 5,659,897 | A * | 8/1997 | Satoh | A63B 71/143 | 2/16 |
| 6,199,209 | B1 * | 3/2001 | Aoki | A63B 69/0059 | 2/19 |
| 2012/0180191 | A1 * | 7/2012 | McNamee | A63B 71/143 | 2/158 |
| 2013/0283490 | A1 * | 10/2013 | Rumer | A63B 71/143 | 2/19 |

* cited by examiner

GLOVE STRUCTURE

FIELD OF THE INVENTION

The present invention relates to an improved structure of ball gloves such as a baseball or softball which is provided with combination of (A) a protective stall or slot for thumb of the glove hand provided with insert and (B) an improved fastening structure provided with index finger bottom fixing sustainer for easy opening/closing operability of the ball glove.

BACKGROUND OF RELATED ART

A Variety of gloves for a baseball and a softball are known. The gloves are used to catch baseballs that are hit and/or thrown toward a user during a game, so players, especially catchers usually receive heavy impact from ball to the thumb which can bend the player's thumb backward. This can cause hyper-extension of the thumb, so that almost ball glove, especially catcher mitt is provided with a protective insert for the thumb. The gloves are also used to tag out players on the opposing team. To tag a player out in front of the base, the user holds the ball in his glove and contacts the opposing player with the glove. At the time of "tag-out" of the running player, the user's hand tends to slip out from the glove and the ball also is likely to be spilled out from the glove by the tag-out violent action when the ball is not caught in the middle pocket of the glove. Especially, at the time of the tag out on the home base, the collision between the catcher and the runner is likely to occur. In many cases, the existing baseball and softball gloves is not enough to protect the user. To solve the problem, a glove structure for enhancing protection of a glove wearing hand has been proposed (patent document 1)

PRIOR ART

Patent document 1: JP 2013-230366

BRIEF SUMMARY OF THE INVENTION

Problem to be Solved by the Invention

However, the conventional protection structure of glove for thumb usually makes the opening/closing operability of the glove worse. Thus, the object of the present invention is to improve the operability of glove together with the improved protection of hand, especially thumb.

Means for Solving the Problem

The present invention relates to a ball glove structure, which improves the functionality of the glove, even though provided with a protective insert for thumb. The inventor found out that, taking it into consideration that the functionality of the glove is depended on mechanism of opening/closing the glove, where the glove can be operated by opening/closing action of the thumb side and the little finger side of the player by using the index finger as the center axis for opening/closing of the glove, the functionality can be improved by securely fixing the bottom of the index finger to be inserted into the glove at the bottom area from a thumb to an index finger. As shown in U.S. Pat. No. 3,57,036 and PCT WO 85/00093, it is well known to the public that a pair of straps is provided for fastening the wrist of the glove hand at the hand opening position, but in any prior arts, there has not been known the straps for fastening the bottom of the index and thumb provided together with the divided opening band. Because the fixing situation or position at the bottom from the thumb to the index finger makes the opening/closing action of the glove very much better and prevents the glove-hand from slipping-out from a hand opening part at the time of tag out. Therefore, the present invention is to provide a glove structure with the mechanism of fixing the bottom area from the thumb to the index finger while keeping the good operability of the thumb bottom. The fixing mechanism is obtained by dividing the hand insert opening band at the center thereof into two parts; one is a thumb side part and the other is a little finger side part and providing a pair of straps where one of the straps is a thumb side strap which is connected with the other strap at the position of the bottom of the index finger passed over the thumb, while the movability of the thumb bottom can be achieved by a box-like thumb slot provided with a hem spread having an enlarged angle ($\alpha$), preferably 15 to 50 degree, relative to the center line of the thumb slot.

Therefore, the present invention is to provide an improved glove structure of ball gloves which comprises an outer shell made from a ball captured palm part and a backing face part by lacing together with binding strings, and a hand opening for inserting glove hand into the glove slots, wherein the improvement comprises two parts, one is a box-like protective stall or slot for thumb provided with a hem spread part having an enlarged angle ($\alpha$) and the other is a fixing structure for the index finger as well as the thumb where a hand opening is divided by a pair of slits (10*a*, 10*a*) at the little finger side of the index finger and a pair of straps (11*a*, 11*b*) comprising a thumb side strap (11*a*) and a little finger side strap (11*b*) are connected together after passing through a pair of the strap slits (10*a*, 10*a*), thereby easily operating the opening/closing of the glove by the thumb and the little finger with the center axis of the index finger to be fixed and preventing the glove-hand from slipped out of the glove at the time of tagging out by a pair of straps to be fastened. In the present invention, an additional fixing structure for the little finger improves the above inventive glove structure more.

Effects of the Invention

According to the present invention, although the hand opening through which the glove hand is inserted, is divided into two parts by a pair of slits (10*a*, 10*a*), the index finger to be the center of glove opening/closing is fixed on its bottom area together with the thumb by connecting and fastening the pair of the straps (11*a*, 11*b*) passed through the slits (10*a*, 10*a*) so as to fasten the operation axis to make a better opening/closing of the glove by the thumb and the little finger with the index finger as the center axis of operation and also to prevent the glove-hand from slipped out from the glove opening at the time of tagging out.

In the present invention, there is provided a box-like protective thumb stall or slot in which a metal or plastic hard piece is provided in a thumb part of a hand back face part without impairing the operability of the thumb, the impact on the thumb at the time of catching can be alleviated. In addition, it is preferable to provide a root support part for the little finger, whereby the glove opening/closing operation of the thumb and the little finger using the index finger as the axis can be facilitated A metal or plastic hard piece is inserted into the upper part of the finger stall or slot in the thumb part, on the other hand, the thumb protective stall or slot has an enlarged angle ($\alpha$) extending from the thumb root to the hand opening, so that the operation of the thumb can be improved without impairing the operability of the thumb.

Further, in order to improve the operability of the little finger part, the little finger root should be supported, so that it is preferable that at the little finger support part the end of the hand opening (5) had better be divided and two strings (23*a*, 23*b*) are pulled outside and the two strings (23*a*, 23*b*) should be tied together for adjusting the support strength of the little finger root support (23).

BRIEF DESCRIPTION OF DRAWINGS

FIG. 1 shows a front view of a backing face side of a catcher mitt according to a first embodiment of the present invention; while FIG. 2 shows a front view of a catching palm surface side of the catcher mitt according to the first embodiment of the present invention. The glove structure comprises a shell, a pad, a lining, a web, wherein the shell is formed by lacing a spherical palm part 1 and a backing face part 2 provided with finger slots at the rim by a binding string 3. The web part is provided between a thumb slot 6 and an index finger slot 7 and a hand opening 5 for inserting the glove-hand is also provided at the bottom between the palm face part 1 and the backing face part 2

FIG. 3 is a front view of the hand backing part 2 of the catcher submit of FIG. 1. In FIG. 3, the backing part 2 comprises a backing leather 21*a* and a finger slot leather 21*b* and the hand opening 5 at the bottom between the backing leather 21*a* and the finger slot leather 21*b*, is divided by a slit 10*a* between an index finger 7 and a middle finger 8 and a slit 10*b* formed outside of a little finger 9 and the divided hand opening part can be connected by a binding band 11 to make a hand opening fastening structure 10 as shown in FIG. 4. The binding band 11 comprises a pair of straps (11*a*,11*b*); one is a thumb side strap 11*a* provided and the other is a little finger side strap 11*b* with a buckle, both of which can be connected together over a thumb protective stall or slot 21 and the hand opening for inserting the glove-hand from the thumb to the little finger can be tightened as shown in FIG. 4.

On the other hand, the thumb stall or slot 21 in which a metal or a plastic hard piece is inserted is provided on the thumb part of the backing face part 2. The thumb stall or slot 21 comprises a backing face leather 21*a*, a cover leather 21*b*, a hard piece 21*c* inserted into the cover and a stopper leather 21*d*, combination of which makes the impact on the thumb to be alleviated at the time of catching the ball. In FIG. 3, as shown in A-A line cross-sectional view, B-B line cross-sectional view and C-C line cross-sectional view, the thumb stall or slot 21 is formed into a box-like shape which is tapered toward the front end while the bottom of box-like stall becomes enlarged like a hem-spread at the opening 21*e* for thumb by an angle (preferably 15° or more and 50° or less) with respect to the vertical center line of the thumb stall or slot (21). This enlarged angle is good for the operation of the thumb at the time of glove opening/closing. Also, as shown in FIG. 5, a support part for a little finger (23) is provided in the vicinity of a slit (10*b*) which is deeply formed in the little finger part. The little finger base support part (23) includes an inner annular part 23*a* and two extraction lace parts (23*b*, 23*b*) which are extracted from the backing face to outside and the base support strength of the little finger can be adjusted by the knot of two extraction lace parts (23*b*, 23*b*). Further, a finger-out opening (22) is provided on the index finger part of the hand-backing face part, as shown in FIG. 5 and the index finger (7) coming out from the finger-out opening (22) functions as the center axis of the glove opening/closing, so that the thumb part (6) and the little finger part (9) can co-operate together with the index finger to make a fixing structure (10) for opening/closing the glove.

Figure 1:
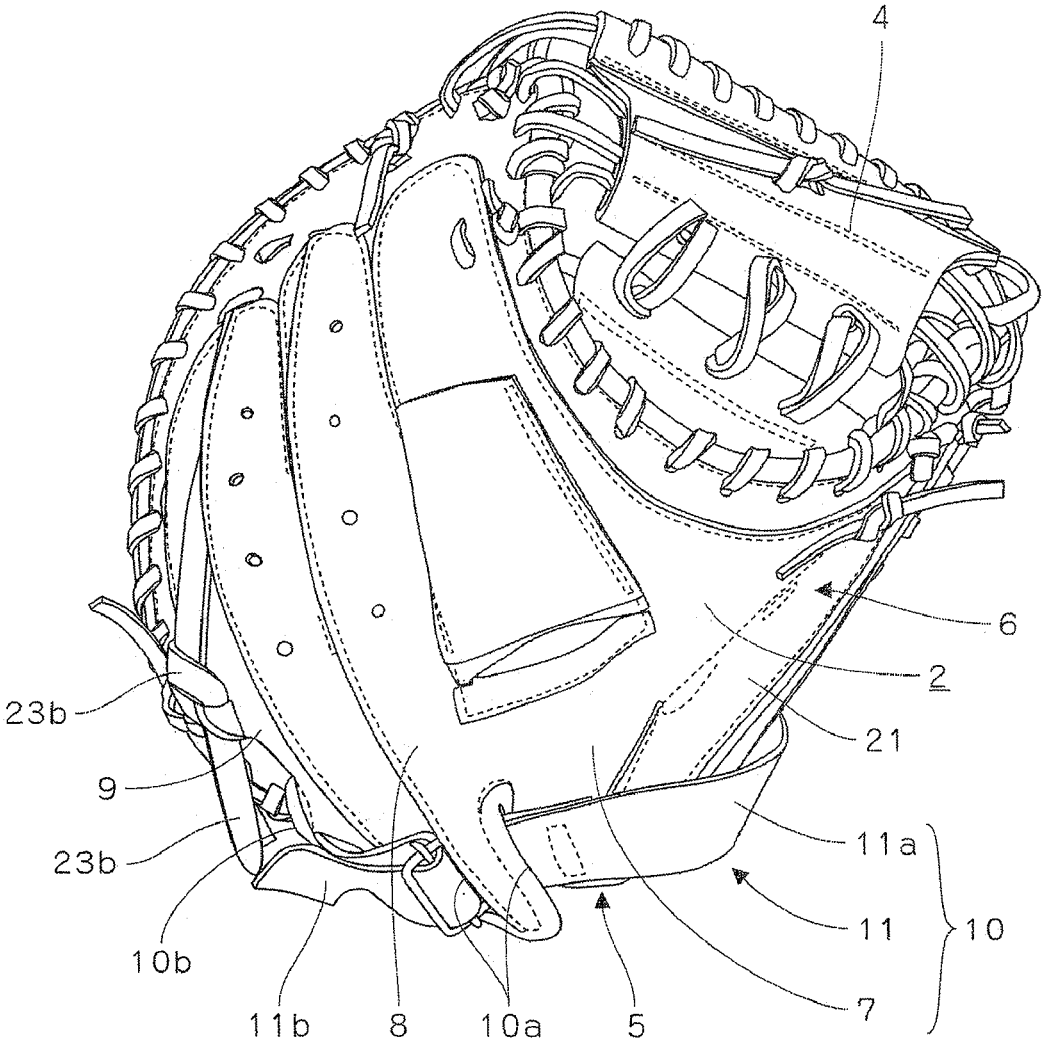
FIG. 1 is a front view of a backing surface side of a catcher mitt according to a first embodiment of the present invention.
Figure 2:
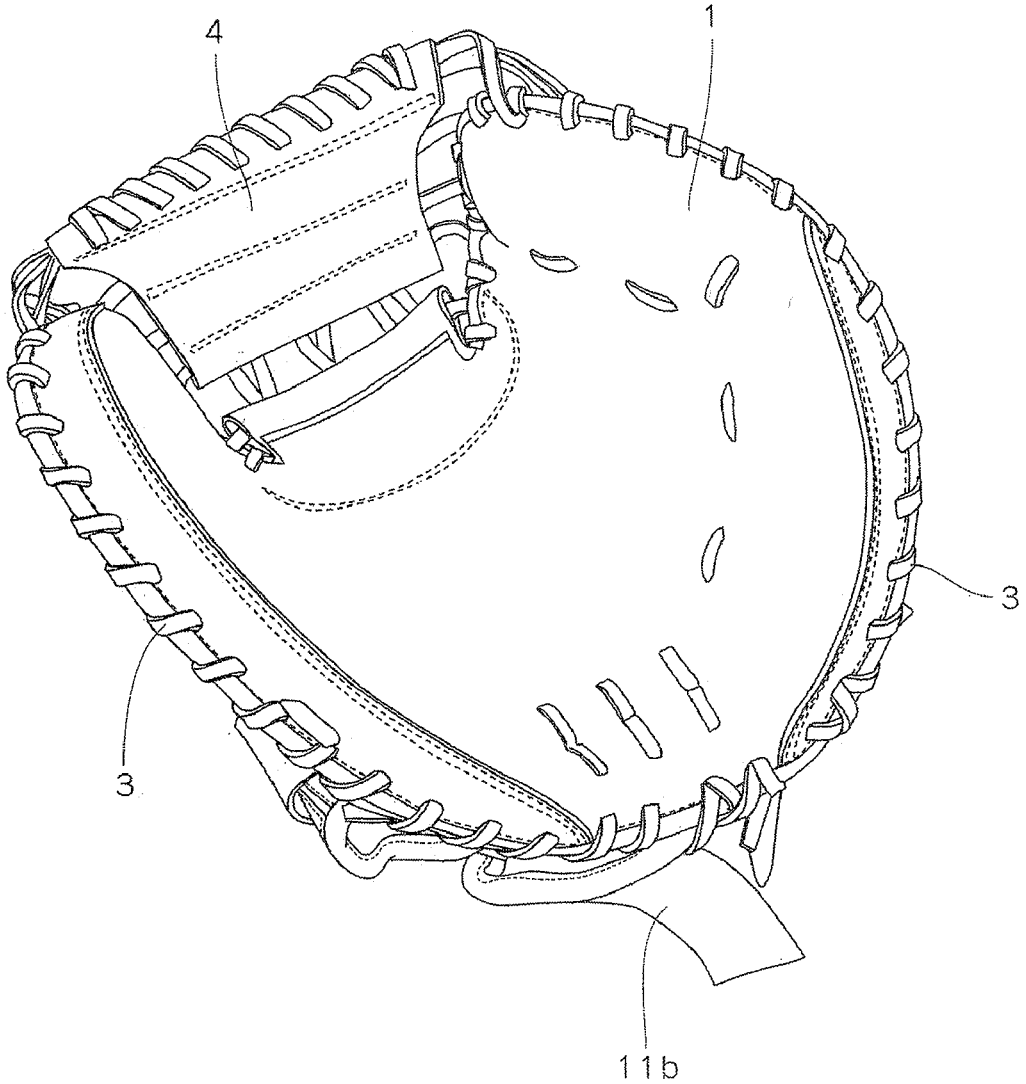
FIG. 2 is a front view of a palm surface side of the catcher mitt of FIG. 1.
Figure 3:
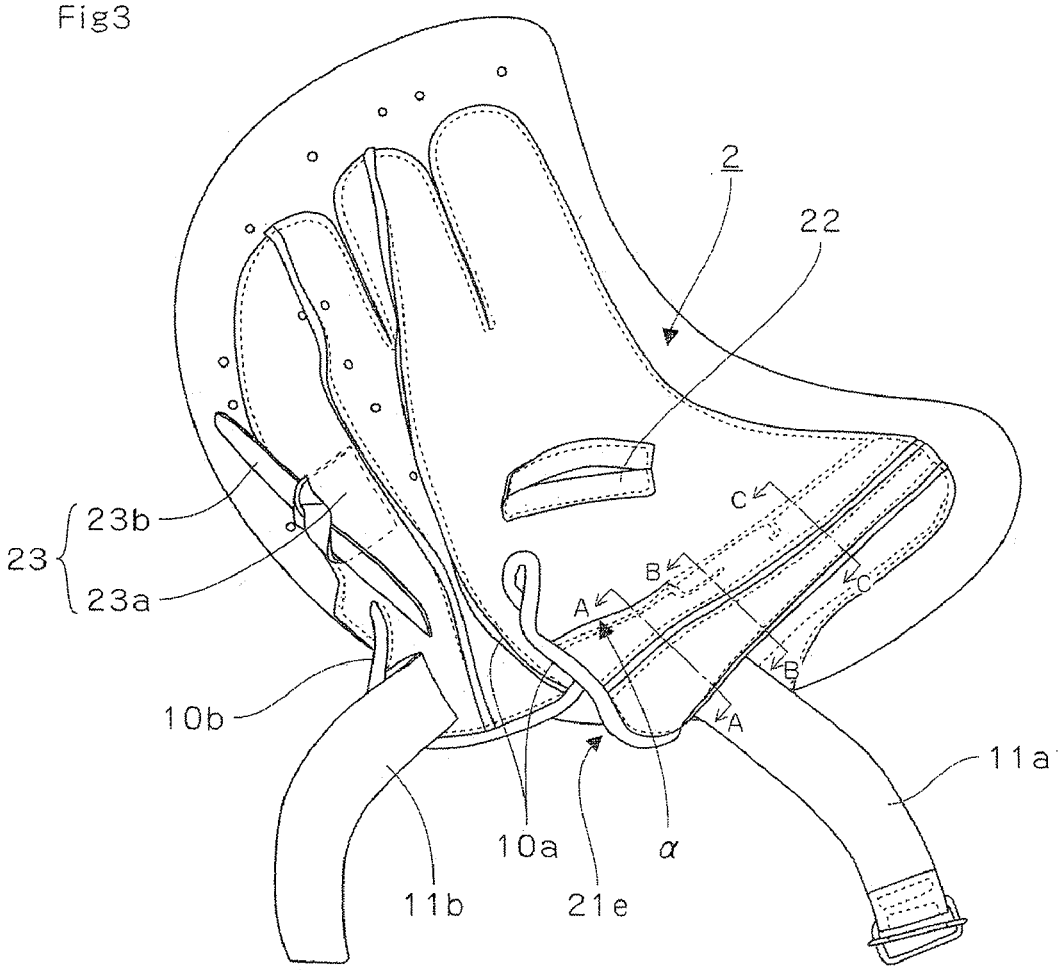
FIG. 3 is a front view of the hand backing part of the catcher mitt of FIG. 1.
Figure 3:
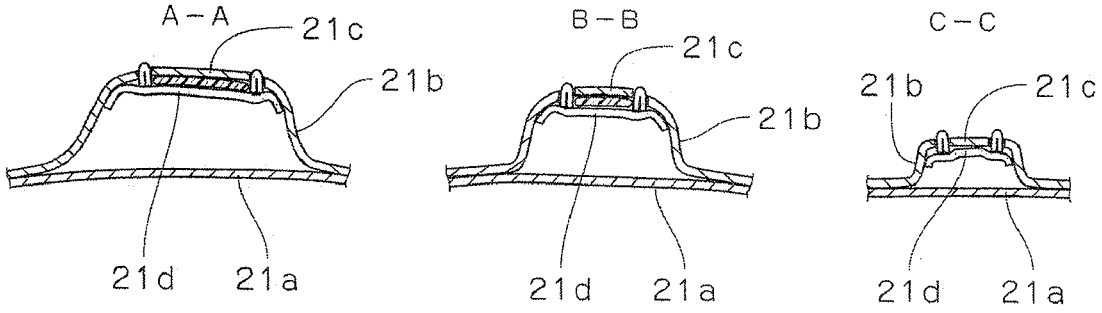
Figure 4:
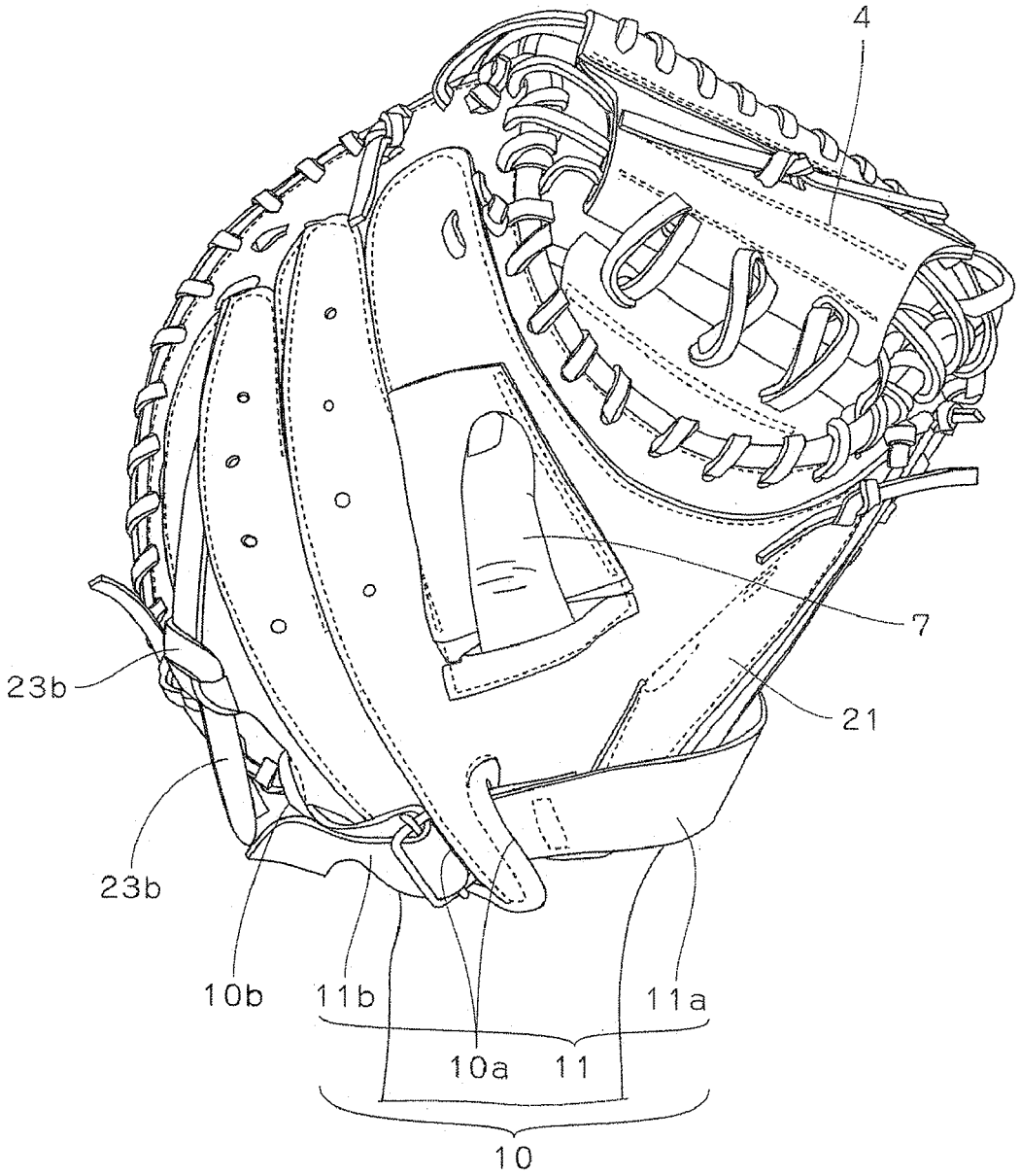
FIG. 4 is a front view showing a state in which a glove-hand is inserted into the catcher mitt of FIG. 1.
Figure 5:
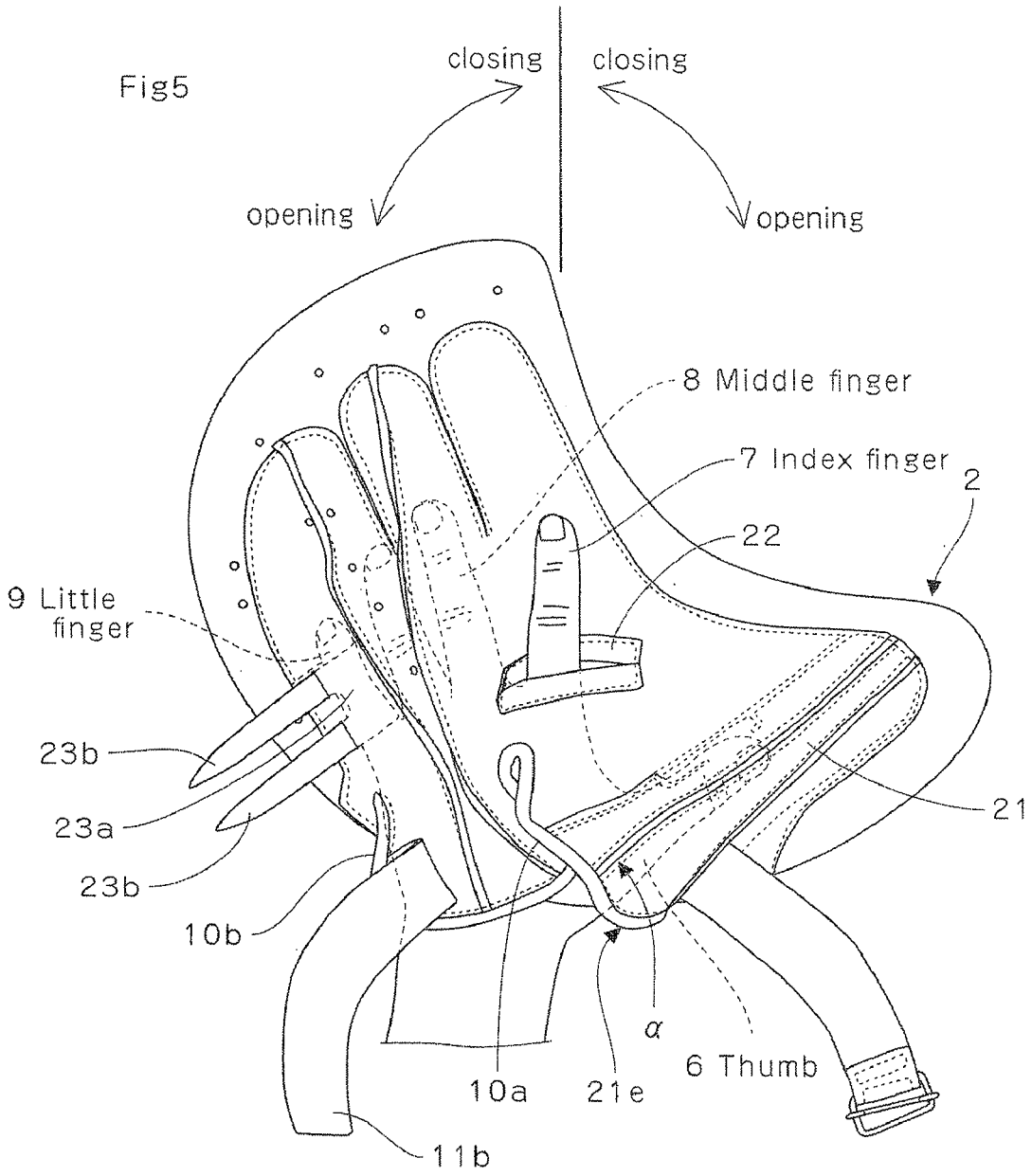
FIG. 5 is a front view of a backing face part showing an operation of opening and closing the glove where a glove-hand is inserted into the finger slots provided on the backing face part.

In the above embodiment, the straps (11*a*,11*b*) are connected, and the thumb is inserted into the thumb stall (21). Next, the index finger is out from the finger out opening (22) and a little finger is inserted into the base support part (23). Under the situation, two extraction laces or strings (23*b*, 23*b*) are tied together to adjust the support strength of the little finger. Finally, the strap (11*a*) on the thumb side and the buckle-attached strap (11*b*) on the little finger side are connected to fasten the divided hand opening parts (5) to prevent the glove-hand from falling-off from the glove.

As is apparent from the above description, according to the glove structure of the present invention, the opening/closing operability (functionality) of the glove is improved without splitting off the hand from the glove. Further, the structure of the present invention has been described in the catcher mitt, but the invention can also be applied to other gloves. Various changes are accompanied in application of other gloves, but as long as the divided hand opening part of the glove can be provided with a fixing structure 10 for the index finger, that is, the divided hand opening part is connected at the bottom of the index finger by a pair of straps (11*a*,11*b*) and the bottom of the index finger can be fixed for using the index finger as the center axis of opening/closing operation of the glove and also the thumb stall or slot is designed as a box-like and provided with a hem spread part for allowing the thumb good movement at the time of opening/closing gloves.

Figure 6:
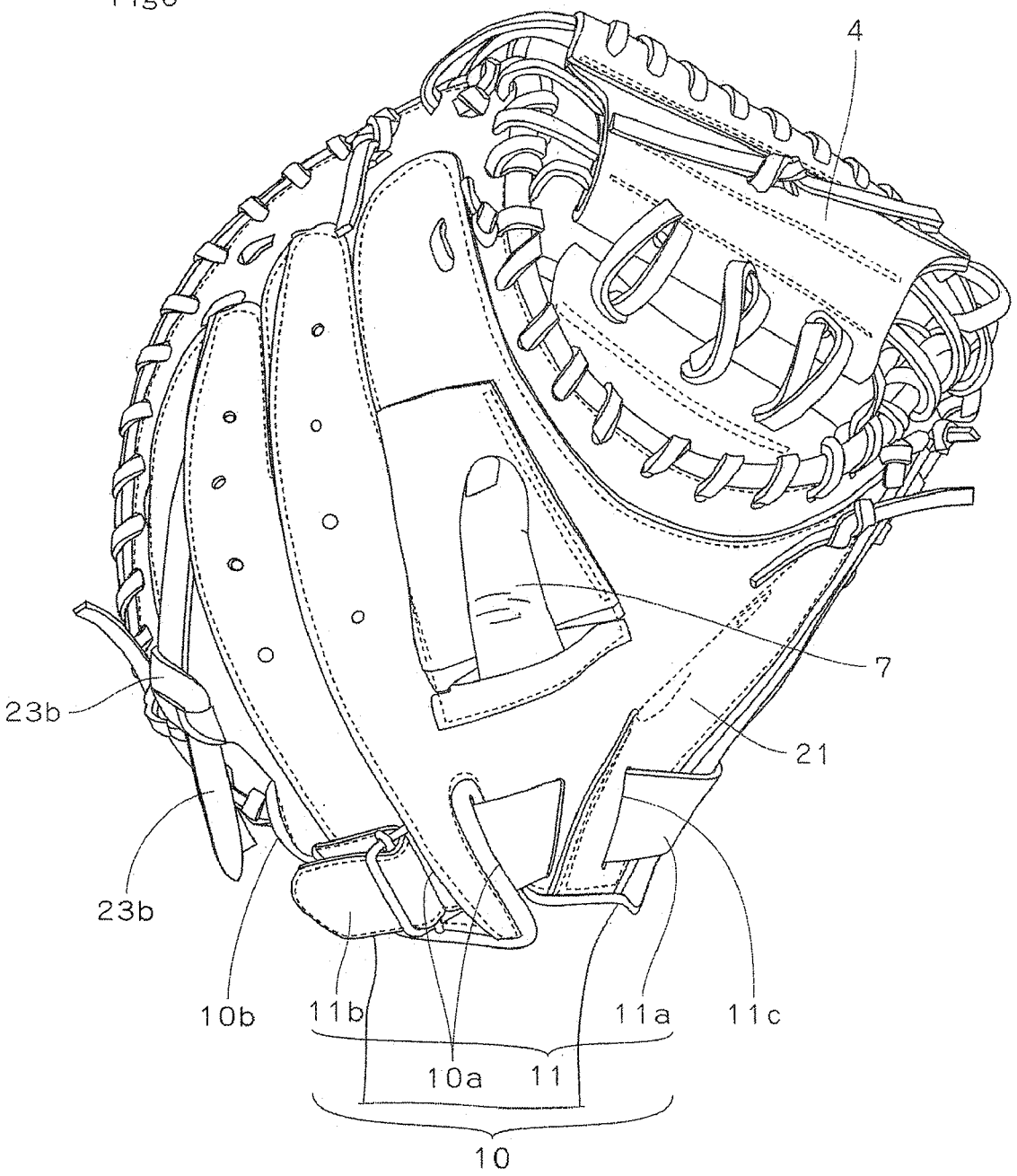
FIG. 6 is a front view of a hand backing surface side of the catcher mitt showing a state in which a hand is inserted into the catcher mitt according to a second embodiment of the present invention.

Many glove structures are intended to be modified within the scope of the present invention. For example, a first arrangement relates to the thumb stall or slot 21. The first embodiment is exemplified by a metal or a rigid plastic piece insertion type, a thumb stall or slot disclosed in JP-a-10-225547 or JP-a-11-216218 may be used so long as it is a box-like shape. Although in case of the first embodiment, as shown in FIG. 1, the thumb-side adjuster, that is, the thumb side strap 11*a* extends over the bottom of the thumb-stall or slot 21 and after passing through the slits (10*a*, 10*a*) it is connected with the little finger side strap 11*b* at the bottom of the index finger. In case of the second embodiment as shown in FIG. 6, the thumb side strap 11*a* extends over the bottom of the thumb-stall or slot 21 and after that the strap 11*a* just comes into the slit 11*c* and then into the slit 10*a* at the bottom of the index finger, the thumb side strap 11*a* may be connected with the little finger side strap 11*b* for securely fixing the thumb and the index finger respectively.

Further, a second arrangement relates to the attached position of the little finger strap. Although as shown in FIG. 1, the little finger side strap 11*b* is attached at the right side (thumb side) of the second slit 10*b*, if the little finger side strap 11*b* is attached at the left side (little finger side) of the second slit 10*b*, an additional slit should be formed close to the right side of the second slit 10*b* and the little finger side strap should be entered into the second slit 10*b* and then comes out from the additional slit. That is, the second slit 10*b* is important for the little finger fixing structure, so that the little finger side strap (11*b*) should be decided depending on whether the second slit (10*b*) is closed or not closed. That is, according to the invention, it is important that the hand opening is divided by the slit at the bottom of the index finger and the divided hand opening is fastened by connecting the thumb side strap with the little finger side strap at the slit positioned at the bottom of the index finger to make a structure 10 for improved functionality of glove, so that various modifications can be made by those skilled in the art without departing from the spirit and scope of the invention.

DESCRIPTION OF CODES

1: catching spherical part
2: hand back face part
3: binding lace
4: Web for catching
5: hand opening part
10: Fastening structure of hand opening part
10*a*, 10*b*: slit
11: 11*a*, 11*b* straps
21 Thumb stall or slot
23 little finger support part

The invention claimed is:

1. A ball glove structure for baseball or softball comprising:

an outer shell formed by lacing together a ball catching palm surface part;

a backing surface part provided with a thumb stall having an opening for inserting a thumb, and finger stalls having a hand receiving opening for inserting a hand and fingers other than the thumb; and a pair of straps provided at a thumb side of the backing surface part as a thumb side strap and a little finger side of the backing surface part as a little finger side strap, wherein the thumb stall including a protective stall is formed in a shape which is tapered toward a fingertip of the thumb, and the thumb stall is gradually enlarged to the opening in a predetermined angle with respect to a longitudinal center line of the thumb stall, the hand receiving opening is provided with a tightening structure where the hand receiving opening of the backing surface part is divided by a slit formed between an index finger and a middle finger, and the thumb side strap is attached to an outer edge of the thumb stall, and the thumb side strap is arranged to pass over the thumb stall in an opening side, come into the backing surface part through the slit for pressing the index finger in a hand receiving opening side, and come out from the backing surface part to connect with the little finger side strap.

2. The ball glove structure set forth in claim 1, wherein the predetermined angle is equal to or more than 15° and equal to or less than 50° and the protective stall is made of a metal or plastic hard piece inserted at the fingertip side of the thumb stall.

3. The ball glove structure set forth in claim 1 further comprising: a little finger base support part including a pair of two extraction laces to be tied together provided at the little finger side of the backing surface part.

4. The ball glove structure set forth in claim 1, further comprising: a second slit formed outside of a little finger at an outer edge of the hand receiving opening, wherein the little finger side strap is attached to the second slit.

* * * * *